US007238075B2

(12) United States Patent
Brodsky

(10) Patent No.: US 7,238,075 B2
(45) Date of Patent: Jul. 3, 2007

(54) PERSONAL WATER ACTIVITY APPARATUS WITH VARIABLE LIGHT DISPLAY FOR PROTECTION AGAINST SHARKS AND OTHER WATER-BORNE PREDATORS

(76) Inventor: Mark A. Brodsky, 17306 Grosvenor Ct., Monte Sereno, CA (US) 95030

( * ) Notice: Subject to any disclaimer, the term of this patent is extended or adjusted under 35 U.S.C. 154(b) by 10 days.

(21) Appl. No.: 11/259,832

(22) Filed: Oct. 27, 2005

(65) Prior Publication Data

US 2006/0094315 A1 May 4, 2006

Related U.S. Application Data

(60) Provisional application No. 60/624,240, filed on Nov. 1, 2004.

(51) Int. Cl.

| | |
|---|---|
| ***B63C 9/00*** | (2006.01) |
| *A63C 5/03* | (2006.01) |
| *B63C 9/08* | (2006.01) |
| *B63B 22/00* | (2006.01) |

(52) U.S. Cl. ..... 441/80; 441/74; 441/129; 441/13; 441/86

(58) Field of Classification Search ..... None
See application file for complete search history.

(56) References Cited

U.S. PATENT DOCUMENTS

| | | | | |
|---|---|---|---|---|
| 4,602,384 | A * | 7/1986 | Schneider | 441/103 |
| 5,883,858 | A * | 3/1999 | Holt | 367/139 |
| 5,888,156 | A * | 3/1999 | Cmiel et al. | 473/570 |
| 7,189,128 | B2 * | 3/2007 | Halliday | 441/64 |
| 2002/0048169 | A1 * | 4/2002 | Dowling et al. | 362/234 |
| 2003/0051674 | A1 * | 3/2003 | Leblanc | 119/220 |
| 2003/0211797 | A1 * | 11/2003 | Hill et al. | 442/205 |
| 2004/0008581 | A1 * | 1/2004 | Nadeau | 367/139 |
| 2004/0105264 | A1 * | 6/2004 | Spero | 362/276 |

* cited by examiner

*Primary Examiner*—Jesus Sotelo
*Assistant Examiner*—Daniel V Venne
(74) *Attorney, Agent, or Firm*—Bruce H. Johnsonbaugh

(57) ABSTRACT

Apparatus for protecting users of surfboards, kayaks and other personal water activity apparatus against sharks and other water-borne predators is provided. A plurality of lights is provided on the bottom and side surfaces of the personal water activity apparatus. The lights are actuated to mask and distort the shadow, shape or outline of the user together with the personal water activity apparatus, in effect camouflaging the user and his or her personal water activity apparatus. The lights may be actuated either manually or automatically. Sensors are provided to detect the stage of ambient light in order to automatically actuate the light sources.

7 Claims, 6 Drawing Sheets

PERSONAL WATER ACTIVITY APPARATUS WITH VARIABLE LIGHT DISPLAY FOR PROTECTION AGAINST SHARKS AND OTHER WATER-BORNE PREDATORS

CROSS-REFERENCE TO RELATED APPLICATION

This application claims the benefit of and priority from U.S. provisional patent application Ser. No. 60/624,240 filed Nov. 1, 2004.

BACKGROUND AND BRIEF SUMMARY OF INVENTION

The present invention pertains generally to the use of a variable and controllable light display on the bottom surface and side surfaces of surfboards, kayaks and other personal water activity apparatus for the purpose of protecting the user against sharks and other water-borne predators. The use of light as disclosed below provides a system for masking and distorting the shadow, shape, or outline of the personal water activity apparatus; in effect, camouflaging the apparatus. The emitted light reduces the shadow against a lighter background. The present invention is an extension of passive lighting used by the Royal Air Force during World War II as a means of blending the aircraft into the daylight background to camouflage the aircraft.

The prior art does include various techniques for protecting individual users of personal water activity apparatus from sharks. These techniques include the use of electric impulse generators (see U.S. Pat. No. 3,822,403; US 2003/0233694 A1; WO 96/37099; US 2005/085064) and alarm devices (see US 2005/0064774 A1). The prior art also includes signaling and/or distress lights on diving vests and floatation devices (see EPO 0909702 A1and U.S. Re 38,475 and U.S. Pat. No. 3,638,258), luminous material on windsurfing boards (Japanese App. 11022874) and signaling/distress lights on flippers or fins (U.S. Pat. Nos. 5,494,468 and 5,785,565); but only as signaling and/or distress lights and not to camouflage the user against sharks. The need for protective systems for use on surfboards, kayaks and other similar devices is evidenced by the frequent reporting of shark attacks and attacks by other water-borne predators. The need for such protective devices is clear.

Recent research regarding shark attacks indicates that sharks have an instinctual "Search Image" that is used in identifying prey. The "Search Image" is the dark shadow of a predator's primary prey which, for sharks, is seals and sea lions. Many studies have shown that people on surfboards create a shadow outline that resembles this "Search Image". Documentary studies ("Air Jaws" on Discovery Channel and PBS studies (shown Sunday Oct. 16, 2005 on KQED in San Francisco), provide evidence that large sea predators use their eyes to search the waters surface for their prey's darker image against the light background in an area around the shore called the "zone of death". Prey animals have taken survival strategies where they avoid the surface in this zone and enter and leave shore by traveling close to the surface or during evening dark. The present invention essentially distorts and/or masks the shark's "Search Image" of a user and a personal water activity apparatus. Further studies suggest that most shark attacks on surfers are due to mistaken identity by the shark. This invention provides a means that causes a shark to be unsure of its prey and may prevent an attack.

As disclosed below, the invention may be utilized with a variety of devices. As used herein and in the claims, the phrase "personal water activity apparatus" means surfboards, boogie boards, water skis, windsurfing boards, kayaks, diving vests, wetsuits, drysuits, flotation vests and flippers or fins.

A primary object of the present invention is to provide a method and apparatus for protection of users of personal water activity apparatus from attacks by sharks and other large water-borne predators.

A further object of the invention is to provide an array of lights on a personal water activity apparatus to distort and/or mask the "Search Image" thereof as perceived by sharks and other water-borne predators.

A further object of the invention is to provide a light pattern on the array of lights on a personal water activity device to mimic the shimmering and twinkling of light on the surface of the water further providing uncertainty to a predator.

A further object of the invention is to eliminate the need for exposed connectors to recharge, toggle, or control the light pattern.

A further object is to provide personal water activity apparatus with a camouflaging variable light display that may be actuated manually by the user or may be automatically controlled by sensors and microprocessors carried on the personal water activity apparatus.

Other objects and advantages of the invention will become apparent from the following description and drawings wherein:

DETAILED DESCRIPTION OF THE DRAWINGS

Figure 1:
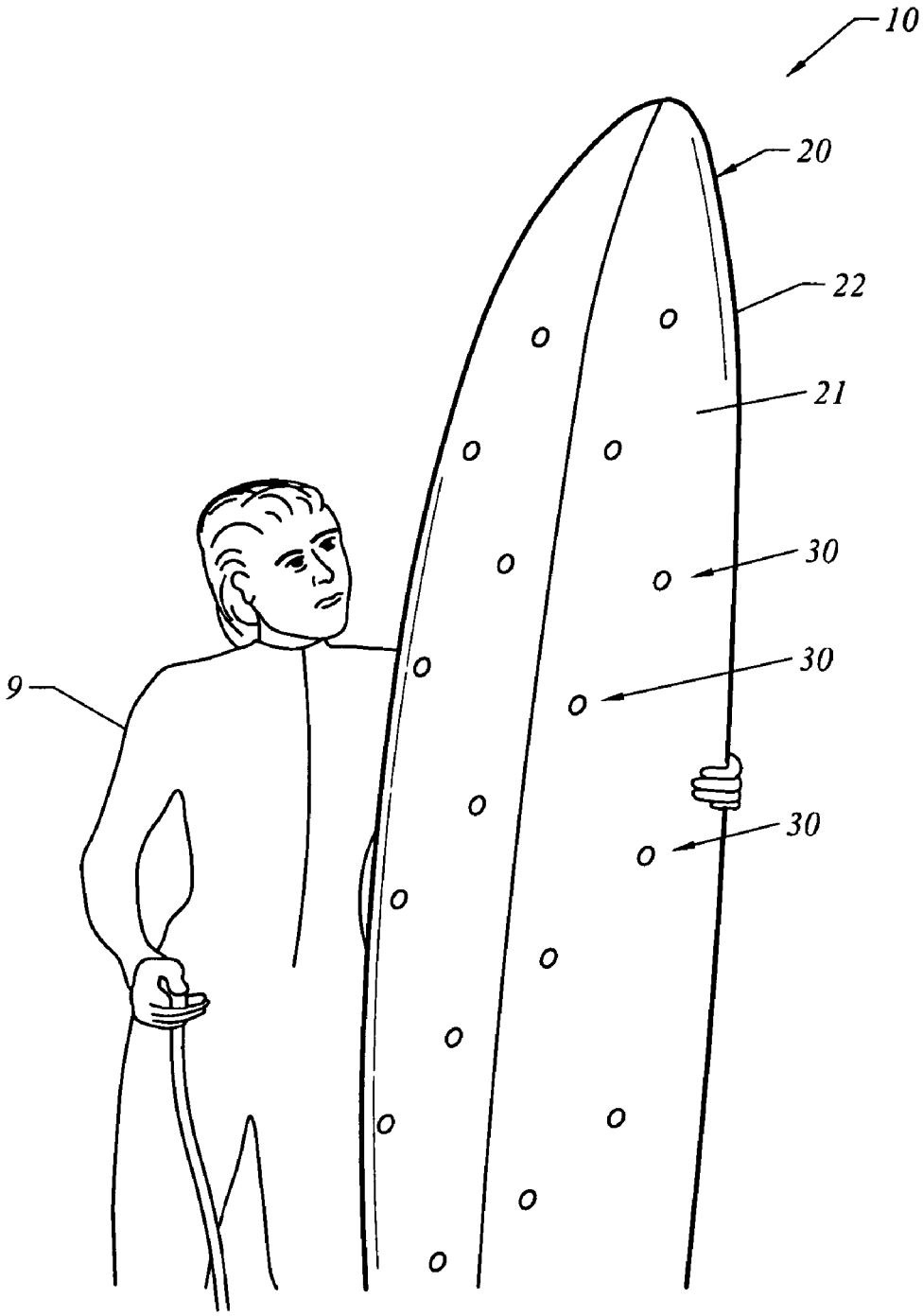
FIG. 1 illustrates a user standing next to a surfboard outfitted with a light array according to the present invention.
Figure 2:
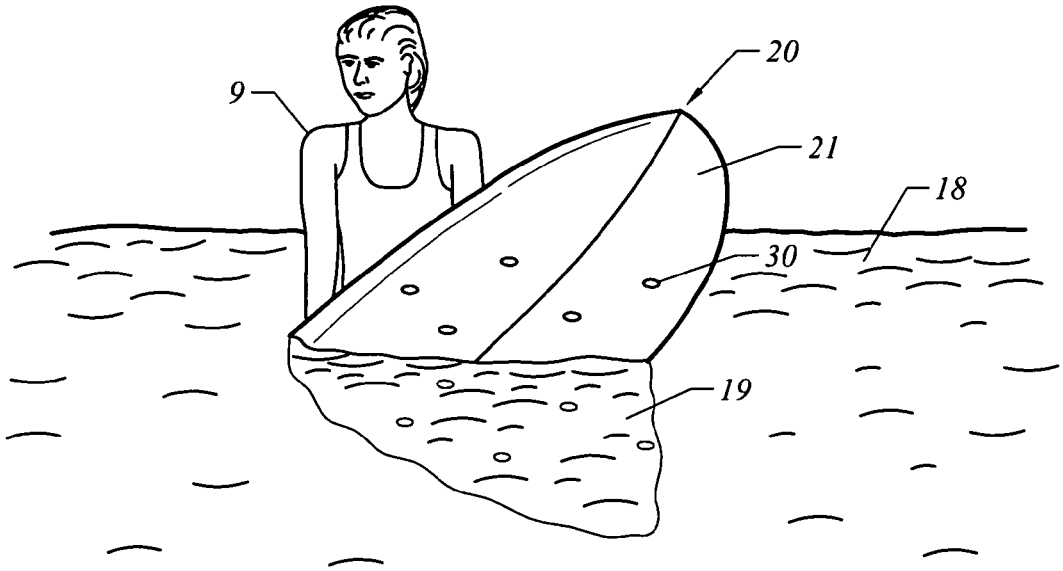
FIG. 2 is a perspective view illustrating the user of a surfboard astride the surfboard in the water.

FIG. 1 illustrates a user 9 standing next to her personal water activity apparatus 10 which, in the embodiment illustrated in FIG. 1, is a conventional surfboard 20. Surfboard 20 has a lower surface 21 and a side surface 22. An array of active light sources is shown generally as 30. The array 30 is carried by the lower surface 21 of surfboard 20. The array 30 may include various numbers of light sources. As shown in FIGS. 1 and 2, twenty separate lights are used.

As shown in FIG. 2, the user is now sitting astride the surfboard 20 on the surface of water 18. Surfboard 20 casts a shadow 19. The purpose of the light array 30 being positioned on the lower surface 21 is to protect the user 9 and her personal water activity apparatus from sharks and other water-borne predators. By causing the light array 30 to emit light when used in areas where sharks or other predators may be present, the "Search Image" created by the light blocking shadow of the surfboard 10 carrying the user 9 as perceived by the shark (or other predator) is distorted and/or masked. The interaction of the emitted light from light array 30 with the shadow 19 and the outline or silhouette of surfboard 20 in effect camouflages the user and surfboard to sharks and other predators.

Figure 3:
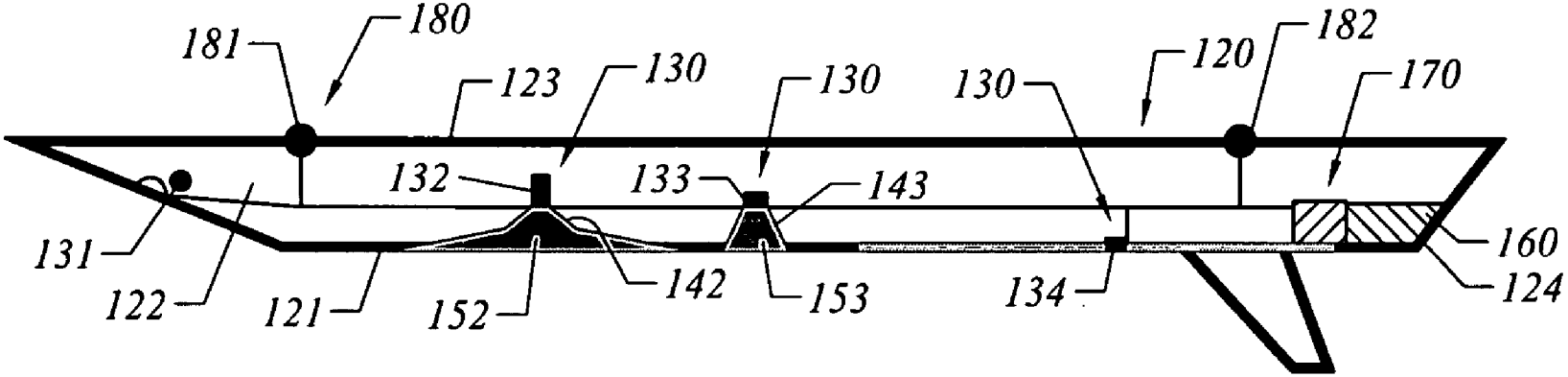
FIG. 3 is a side elevational and sectional view of a surfboard outfitted with the present invention, the sectional view being taken on the line 3-3 of FIG. 4.
Figure 4:
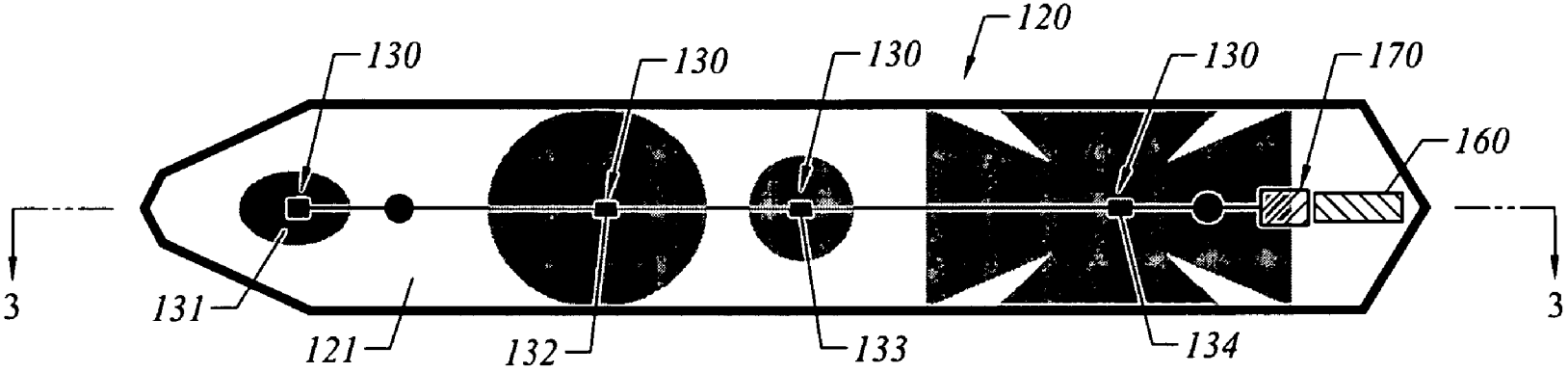
FIG. 4 is a bottom view of the surfboard illustrated in FIG. 3.

FIG. 3 is a side sectional view of another surfboard 120 along the line 3-3 of FIG. 4. The light array 130 as illustrated in FIGS. 3 and 4 includes four separate light sources 131-134. The light sources 131-134 may be any electrically stimulated source of light including light emitting diodes, incandescent bulbs, or fluorescent bulbs, wires and coatings. The light sources 131-134 may be used with or without reflectors. In the embodiment shown in FIGS. 3 and 4, light sources 132 and 133 are used in conjunction with conical reflectors 142 and 143. Light sources 131 and 134 are used without reflectors. Each of the light sources 131-134 may also be used together with diffusers. As shown in FIGS. 3 and 4, light sources 132 and 133 are used together with diffusers 152 and 153. Light sources 131 and 134 are not used in conjunction with light diffusers. The light sources, reflectors and diffusers are mounted in the lower surface 121 of surfboard 120 in a manner to preserve the smooth lower surface in order to not affect the performance of the surfboard 120 on the water. The lights, reflectors and diffusers are mounted in waterproof sealed units and are preferably applied to surfboard 120.

A waterproof power supply 160 is preferably sealed inside the body of the surfboard 120 where it can be inductively or photoelectrically recharged. The power supply is a source of stored electrical energy such as a battery or fuel cell in a protective enclosure, as is known in the art, and provides energy to the various components of the system including the light array 130 and the sensing devices and control circuitry described below.

A control means 170 is provided, preferably a microprocessor, capable of receiving input from sensing devices described below and activating the light array 130 in a programmed sequence, pattern, periodicity or intensity.

Sensing means 180 includes two sensors 181 and 182 positioned on the upper surface 113 of surfboard 110. The sensing means 180 may be any photodetector or electronic sensor for determining the level of ambient light.

Figure 5:
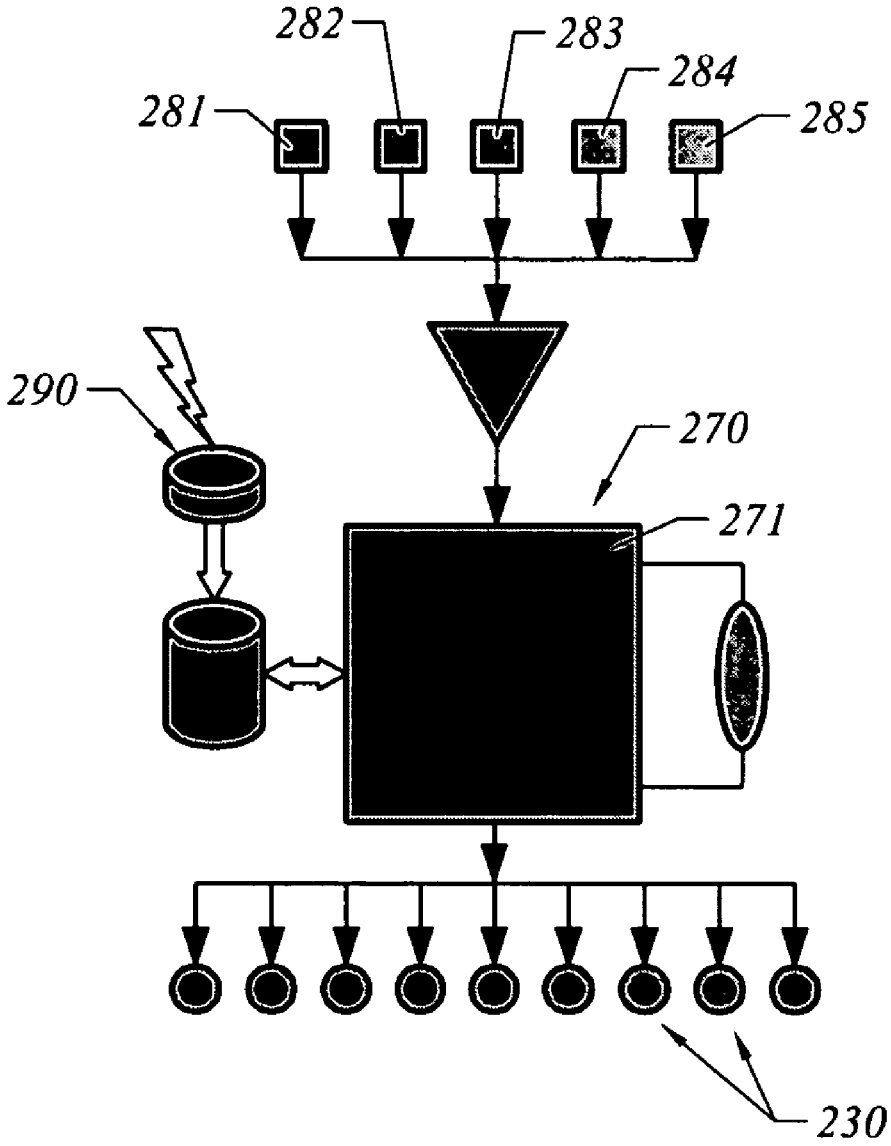
FIG. 5 is a flow diagram of the control system used with the invention.

FIG. 5 is a flowchart showing control means 270 interacting with light array 230 having nine separate lights. Control means includes a microprocessor 270. A sensor 290 collects information from the environment, including ambient light level and variables such as acceleration, speed and orientation. Multiple power supplies 281-285 are connected to microprocessor 271 through a voltage regulator. An actuation means 271, such as a magnetic reed switch actuator, may be optionally utilized to initiate a sequential pattern of lights to be displayed. Alternately, the microprocessor can be programmed to ignore input from the manual actuator 271 and to initiate a lighting sequence in response to input from sensor 290 with predetermined levels of variables such as the level of ambient light.

Figure 6:
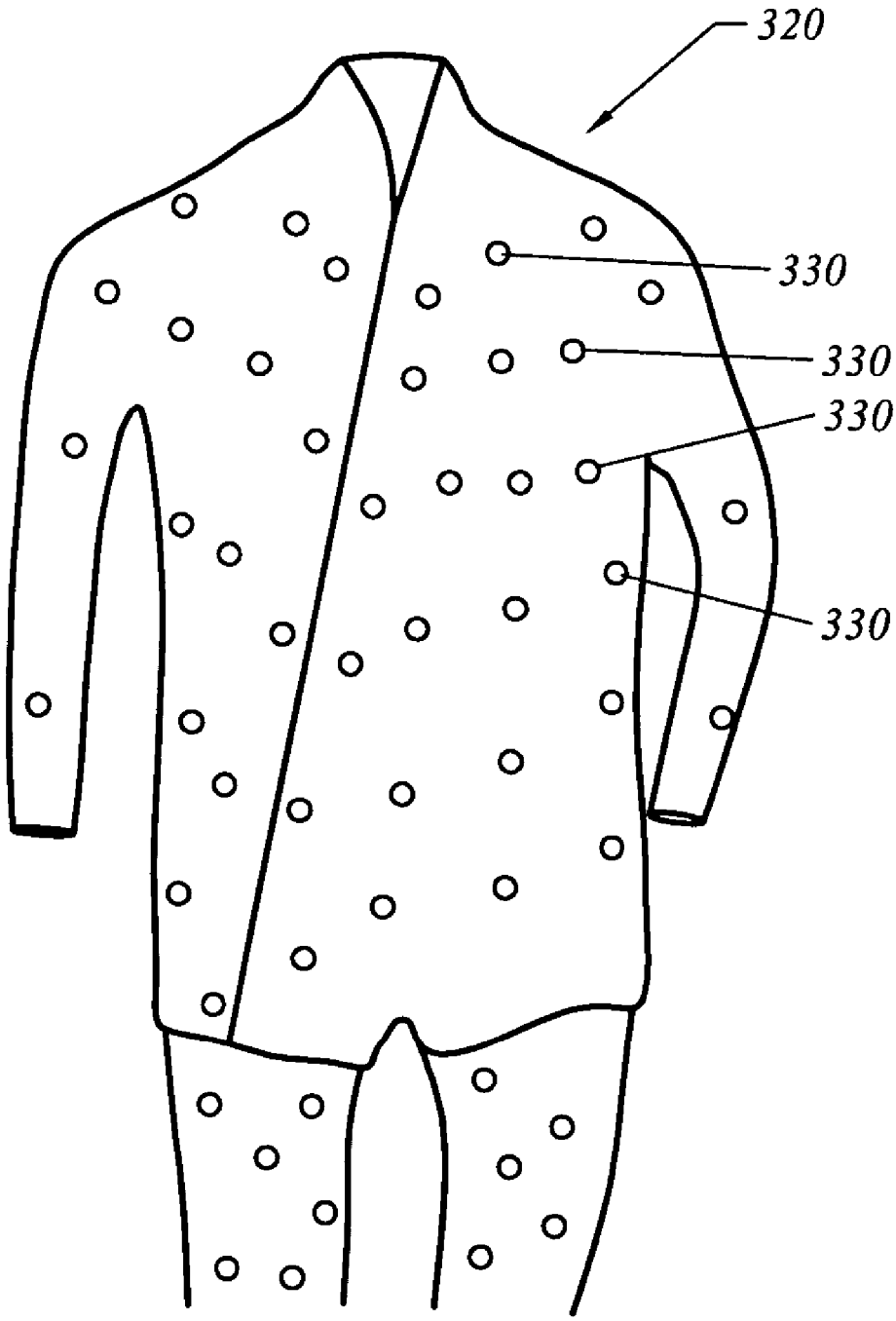
FIG. 6 illustrates a diving suit outfitted with an embodiment of the invention.

FIG. 6 illustrates a diving vest 320 carrying an array of lights in accordance with the invention. The control means and sensors are not shown in the interest of brevity.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. Apparatus for masking and/or distorting the shadow, shape or outline of a personal water activity apparatus which creates a search image for sharks that resembles a seal or sea lion, in order to protect a user of said personal water activity apparatus from attack by sharks and other water-borne predators that prey on seals or sea lions, comprising:

a personal, non-inflatable water activity apparatus usable on the surface of water, said personal water activity apparatus having an upper surface and a lower surface, an array of active light sources carried by said lower surface of said personal water activity apparatus, wherein said light sources distort the shadow or outline of said personal water activity apparatus so that said shadow or outline does not resemble a seal or sea lion, a waterproof power supply carried by said personal water activity apparatus, control means for controlling the state, sequence, periodicity and intensity of the light emitted from said light sources, sensing means carried by said personal water activity apparatus for sensing the state of ambient light, and actuation means for causing said control means to initiate a programmed light display, whereby said control means is electronically connected to and responsive to said actuation means to activate and cause one or more of said light sources to emit light of an intensity, sequence, periodicity and location relative to said surfaces of said personal water activity apparatus to mask and/or distort the shadow, shape or outline of said personal water activity apparatus.

2. The apparatus of claim 1 wherein said actuation means is a manual actuator.

3. The apparatus of claim 1 wherein said actuation means is an automatic actuator and wherein said control means is a programmable microprocessor programmed to respond to said sensing means and to initiate a light display when predetermined variables are sensed by said sensing means.

4. The apparatus of claim 1 wherein said active light sources are light emitting diodes.

5. The apparatus of claim 1 wherein said active light sources are incandescent or fluorescent bulbs, wires or coatings.

6. The apparatus of claim 1 further comprising reflectors used together with said light sources.

7. The apparatus of claim 1 further comprising diffusers used together with said light sources.

* * * * *